United States Patent [19]

Goren

[11] 4,012,137

[45] Mar. 15, 1977

[54] OPTICAL SYSTEM HAVING A ROTATING SCREEN

[75] Inventor: Robert N. Goren, Rochester, N.Y.

[73] Assignee: Xerox Corporation, Stamford, Conn.

[22] Filed: Jan. 17, 1975

[21] Appl. No.: 541,748

[52] U.S. Cl. ..... 355/4; 355/11; 355/71

[51] Int. Cl.[2] ..... G03G 15/26

[58] Field of Search ..... 355/3 R, 4, 8, 11, 67, 355/71, 35–38; 96/116–118, 45

[56] References Cited

UNITED STATES PATENTS

| | | | |
|---|---|---|---|
| 3,158,479 | 11/1964 | Pluess | 96/45 |
| 3,195,405 | 7/1965 | Clark et al. | 355/71 X |
| 3,260,152 | 7/1966 | Aston | 355/35 |
| 3,467,468 | 9/1969 | Johnson | 355/71 X |
| 3,469,914 | 9/1969 | Thomson | 355/35 X |
| 3,506,350 | 4/1970 | Denner | 355/71 X |
| 3,517,596 | 6/1970 | Johnson et al. | 355/4 X |
| 3,635,555 | 1/1972 | Kurahashi et al. | 355/8 |
| 3,724,943 | 4/1973 | Draugelis et al. | 355/4 |

*Primary Examiner*—L. T. Hix
*Assistant Examiner*—Kenneth C. Hutchison
*Attorney, Agent, or Firm*—J. J. Ralabate; H. Fleischer; C. A. Green

[57] ABSTRACT

An optical system in which a light image of an original document is projected onto a light sensitive member. The light image passes through a rotating screen at discrete time intervals forming successive half-tone light images at differing screen angles.

14 Claims, 6 Drawing Figures

OPTICAL SYSTEM HAVING A ROTATING SCREEN

BACKGROUND OF THE INVENTION

This invention relates generally to electrophotographic printing, and more particularly concerns an optical system employed therein for forming a half-tone light image of an original document being reproduced.

Conventional screening methods employed in electrophotographic printing machines produce the effect of tone graduation by means of dot size variations. In the highlight regions, the dots are small and increase in size through the intermediate shades until they merge together in the shadow regions. At the extremes, there is complete whiteness at the highlight end of the tone scale and nearly solid black at the shadow end. This type of tone structure can be reproduced in an electrophotographic printing machine.

Many techniques have been developed to improve half-tone reproductions. In graphic arts, moire patterns are minimized by changing the screen orientation between successive single color half-tone patterns. With the advent of colored electrophotographic printing, screening techniques have been employed to improve copy quality. Multi-colored electrophotographic printing is substantially identical to black and white printing. The process of black and white electrophotographic printing is described in U.S. Pat. No. 2,297,691 issued to Carlson in 1942. In multi-color electrophotographic printing, the light image is filtered producing successive single color light images of the original document. These colored light images expose a charged photoconductive surface to create successive single color electrostatic latent images thereon. Each single color electrostatic latent image is developed with toner particles complementary in color to the filtered light image. The toner powder images are transferred from the electrostatic latent images to a sheet of support material, in superimposed registration with one another. This multi-colored powder image is permanently affixed to the sheet of support material forming a color copy thereon.

Half-tone screens are used in multi-colored electrophotographic printing system to enhance the copy being reproduced thereby. The screen is interposed into the optical light path and successive single color light images are transmitted therethrough onto the charged photoconductive surface to form an image of dots. In multi-color lithography and gravure reproductions, the screen may be rotated to discrete orientations for each single color image. By way of example, U.S. Pat. No. 3,158,479 issued to Pluess in 1964 describes such a concept.

It is a primary object of the present invention to improve the optical system of a multi-color electrophotographic printing machine by substantially optimizing the half-tone single color light images and the contrast thereof.

Another object of the present invention is to provide a convenient and rapid system for producing the proper discrete orientations for each single color image in a full color half-tone reproduction.

SUMMARY OF THE INVENTION

Briefly stated, and in accordance with the present invention, there is provided an optical system for projecting a light image of an original document onto a light sensitive member.

Pursuant to the features of the present invention, means are provided for illuminating the original document. Means, in a light receiving relationship with the light rays transmitted from the original document, form a light image thereof. A screen member is interposed in the optical path, and means rotate the screen member as the light image passes therethrough. Finally, means are provided for activating the illuminating means at pre-selected timed intervals synchronized with the rotation of the screen member. In this manner, successive half-tone light images are generated with the screen member at differing angular orientations.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
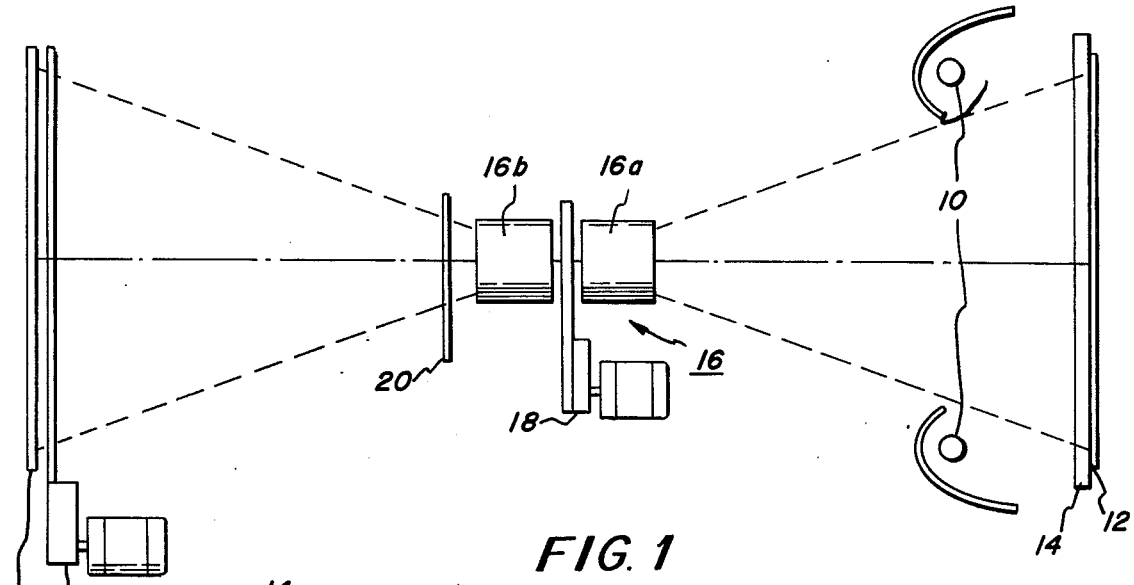
FIG. 1 is a schematic elevational view of an electrophotographic process showing the general operation of the present invention therein.
Figure 2:
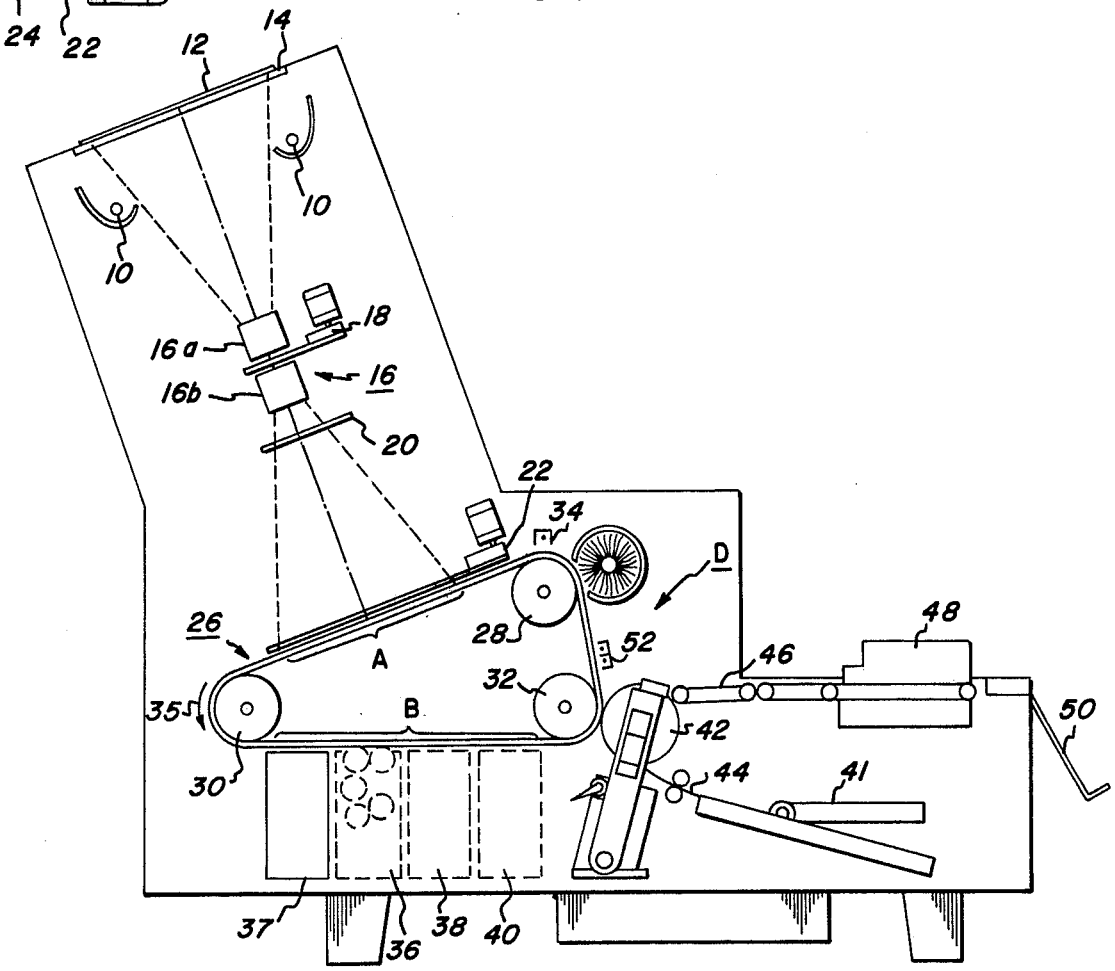
FIG. 2 is an elevational view depicting an electrophotographic printing machine incorporating the feature of the present invention therein.

With continued reference to the drawings, FIG. 1 schematically illustrates a color electrophotographic process which employs the features of the present invention therein. In the drawings, like reference numerals have been used throughout to designate like elements. The electrophotographic process shown schematically in FIG. 1 is employed in the electrophotographic printing machine of FIG. 2. As shown in FIG. 2, the electrophotographic printing machine is adapted to produce colored copies from a colored original document. The present invention is directed to an optical system which is capable of creating successive half-tone light images of variable contrast. Although this optical system is particularly well adapted for use in a multi-color electrophotographic printing machine, it will become evident from the following description that it is equally well suited for use in a wide variety of printing machines and is not necessarily limited to the particular embodiment shown herein. For example, the original to be copied could be a colored transparency instead of an opaque original. Moreover, in lieu thereof, the original could be a set of black and white separation of the original, projected in registration with one another.

As shown schematically in FIG. 1, a light source 10 illuminates an original document 12 disposed face down upon a transparent platen 14. The light rays reflected from original document 12 pass through split lens 16. An aperture system 18 is interposed between portion 16*a* and 16*b* of lens 16. Aperture system 18 includes a disc mounted rotatably within a housing having a window therein. The disc has a plurality of different size apertures therein. As the disc rotates, different size apertures are interposed between lens 16*a* and 16*b* varying both the intensity and contrast of the half-tone light image produced by screen member 22. The light image formed by lens 16 passes through filter mechanism 20. Filter mechanism 20 interposes selected color filters into the optical light path to produce a single color light image. Preferably, red, blue and green filters are employed. Each filter is successively interposed into the optical path producing a red light image, a green light image and a blue light image. The single color light image then passes through a rotating half-tone screen member 22. Screen member 22 is continuously rotating and comprises a square array of dots thereon. Light source 10 is periodically activated forming half-tone images at various orientations.

In a preferred embodiment, light source 10 is activated when screen member 22 is orientated with one edge of the square array of half-tone dots at 15° angle with respect to the horizontal. Light source 10 is again activated when one edge of the square array of half-tone dots of screen member 22 is at an orientation of 45° and 75° relative to the horizontal. Light source 10 continues to be sequentially activated at angles of $15° + n90°$, $45° + n90°$, and $75° + n90°$. Where $n$ is an integer which by the symmetry of the square array of dots are equivalent to 15°, 45° and 75°. When screen member 22 has rotated to about a 15° angle or the equivalent thereof, a green filter is interposed into the optical light path. After screen member 22 has rotated to about a 45° angle, or the equivalent thereof, a red filter is interposed into the optical light path. Finally, when screen member 22 has rotated to about a 75° angle or the equivalent thereof, a blue filter is interposed into the optical light path. Screen member 22 rotates continuously at a substantially constant angular velocity in its plane. The single color light image passing through screen member 22 irradiates charged photoconductive member 24. Irradiation of charged photoconductive member 24 selectively dissipates the charge thereon to produce a single color electrostatic latent image thereon. Each of the foregoing latent electrostatic images are developed with toner particles complementary in color thereto. These toner powder images are transferred, in superimposed registration with one another, to a sheet of support material forming a color copy of the original document. The foregoing will be described, in greater detail, with reference to FIG. 2 which illustrates an electrophotographic printing machine incorporating the features of FIG. 1 therein.

Referring now to FIG. 2, an original document 12 is positioned upon platen 14. Light source assembly 10 illuminates original document 12 disposed upon platen 14. While upon platen 14, a program system for the electrophotographic printing machine introduces a lamp control circuit to cause successive energization of the lamps in light source assembly 10. The light rays reflected from original document 12 pass through a six element split dagor lens assembly 16 having an aperture system 18 interposed between lens component 16*a* and 16*b*. The light image is then transmitted through the separation filter of filter mechanism 20, thereby producing a light image corresponding to a single color of the color informational areas on original document 12. The single color light image is then projected through rotating screen member 22 to expose the charged photoconductive surface of flexible belt 26 at exposure station A. Endless belt 26 is entrained about three rollers 28, 30 and 32, respectively. The rollers are adapted to drive belt 26 at a constant rate in the direction of arrow 34. During this movement of the belt, single color light images are successively flashed, full frame, upon the surface of belt 26. Belt 26 has a layer of photoconductive insulating material, such as selenium, on a conductive backing. Prior to exposure, belt 26 is sensitized by means of a suitable corona generating device 34.

The flash exposure of the charged photoconductive belt 26 discharges the charge in the areas irradiated by the light image. In this way, there remains an electrostatic latent image recorded on the belt corresponding to the single color light image projected from original document 12. As heretofore indicated, the appropriate color filter operates on the light image to record an electrostatic latent image on photoconductive belt 26 corresponding to a pre-selected spectral region of the electromagnetic wave spectrum, hereinafter referred to as a single color electrostatic latent image.

With continued reference to FIG. 1, after charged photoconductive belt 26 is exposed, it continues to move in the direction of arrow 34 to rotate successive single color electrostatic latent images to development station B. At development station B, four individual developer units, generally indicated by the reference numerals 34, 36, 38 and 40, respectively, are provided to develop individual single color electrostatic latent images. Preferably, the developer units are all of a type generally referred to as magnetic brush developer units. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential such that the toner particles are attracted from the carrier granules to the areas of photoconductive belt 26 having a greater charge thereon, i.e. the single color electrostatic latent image. The single color electrostatic latent image recorded on photoconductive belt 26 is developed by bringing the brush of developer mix into contact therewith. Each of the respective developer mixes contain discretely colored toner particles corresponding to the complement of the wave length of light transmitted through filter 12, e.g. a green filtered electrostatic latent image is rendered visible by depositing green absorbing magenta toner particles thereon, blue and red latent images are developed with yellow and cyan toner particles, respectively. Thus, developer units 34 will contain yellow toner particles, developer unit 36 magenta toner particles and developer unit 38 cyan toner particles. Finally, in the event a black and white copy is being reproduced or if a four color half-tone copy of a colored original is being produced using under color removal techniques known in the art, black toner particles are provided in the developer unit 40.

The successively developed single color electrostatic latent images are transported by photoconductive belt 26 to a transfer station C. At transfer station C, a sheet of support material is moved at a speed in synchronism with moving photoconductive belt 26 in order to accomplish transfer of the developed images. There is provided at this station a sheet transport mechanism 41 arranged to advance successive sheets to transfer roll 42. The sheet of support material is secured releasably thereon, and rotates in a recirculating path therewith. This permits successive single color powder images to be transferred thereto in superimposed registration with one another. The transfer of developed images from photoconductive belt 26 to the sheet of support material is achieved by electrically biasing transfer roll 42 to the proper polarity and magnitude.

After a plurality of toner powder images have been transferred in registration with one another to support material 44, the sheet of support material is stripped from transfer roll 42. Conveyor 46 advances the sheet of support material with the multi-layered toner powder image thereon into a fuser assembly, generally indicated by the reference numeral 48. The multi-layered toner powder image on the sheet of support material is permanently affixed thereto in fuser 48. After fusing, the finished color copy is discharged into catch tray 50 enabling the machine operator to readily remove it therefrom.

Invariably, some residual toner particles remain on photoconductive belt 26 after the transfer of the toner powder image therefrom to support material 44. These residual toner particles are removed from photoconductive belt 26 as it passes through cleaning station D. At cleaning station D, a cleaning corona generating device 52 neutralizes the electrostatic charge remaining on the residual toner particles and that of photoconductive belt 26. The neutralized toner particles are then removed from photoconductive belt 26 by rotatably mounted brush 54 in contact therewith.

It is believed that the foregoing description is sufficient for purposes of the present application to illustrate the general operation of an electrophotographic printing machine embodying the teachings of the present invention therein.

Figure 3:
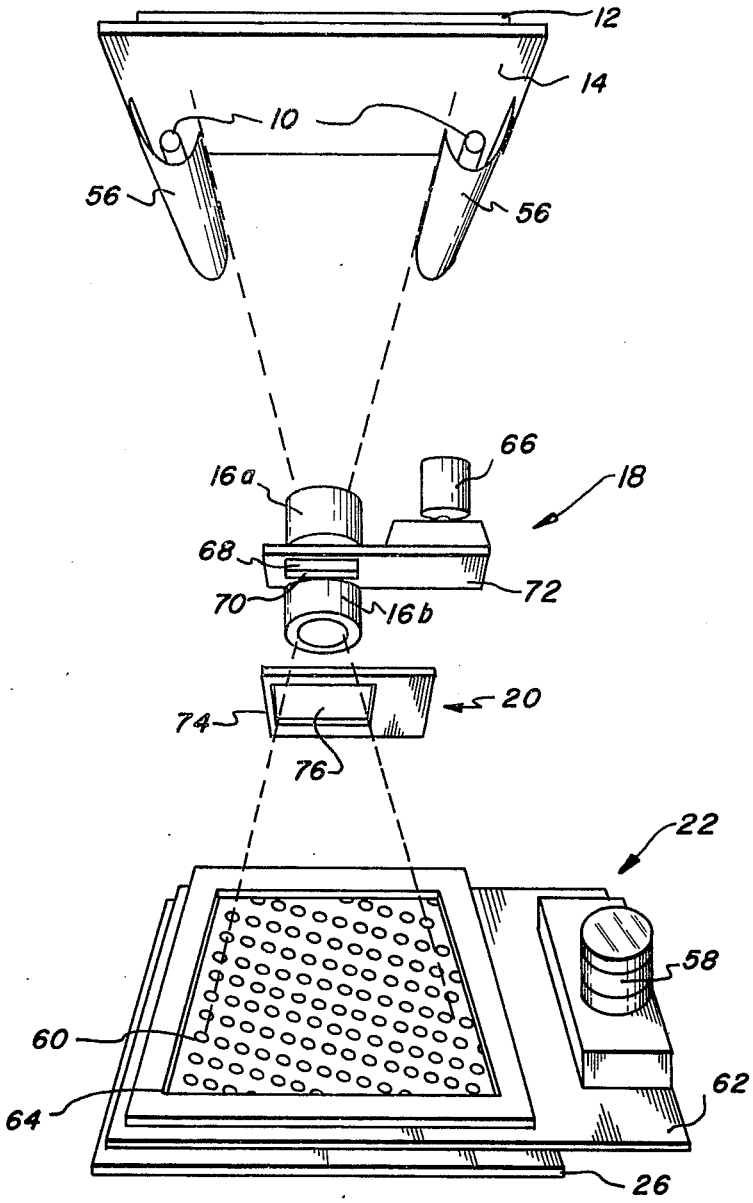
FIG. 3 is a perspective view of the FIG. 1 printing machine optical system.

Referring now to FIG. 3, the optical system of the present invention is depicted therein in greater detail. The optical system includes a pair of light sources or lamps 10 adapted to be periodically activated by the circuitry associated with the printing machine when an original document 12 is disposed upon platen 14. Reflectors 56 are disposed beneath lamps 10 and are arranged to direct the light rays onto original document 12 providing full frame exposure. The foregoing system is a flash exposure system which is periodically excited in synchronism with the rotation of screen member 22. Screen member 22 is rotated at a constant angular velocity by a hysteresis motor 58. Screen member 22 includes a transparent disc having a plurality of dots disposed thereon. The dots may be formed by suitable chemical etching or photographic techniques on a transparent substrate. Transparent disc 60 is mounted in a housing 62 having a square window 64 therein. As disc 60 rotates, the square array of dots thereon form differing angles with the horizontal of housing window 64. In a preferred embodiment, lamps 10 are activated when the square array of dots is at a 15° angle with respect to the horizontal of housing window 64, and a green filter is interposed into the optical light path. Lamps 10 are again activated when the square array of dots is at a 45° angle with respect to the horizontal of the housing window 64, and a red filter is disposed into the optical light path. Finally, lamps 10 are activated when the square array of dots is at a 75° angle with respect to the horizontal of housing window 64, and a blue filter is interposed into the optical light path. Inasmuch as motor 58 rotates disc 60 within housing 62 at a substantially constant angular velocity, the timing circuitry associated with lamp 10 may be presynchronized to flash lamps 10 at the appropriate time corresponging to the appropriate angular rotation of the square array of dots on disc 60 within window 64 of housing member 62, i.e. at 15°, 45° and 75° or in 30° increments.

Alternatively, if it is desired to make black and white copies, the lamps may be energized or flashed at 45° or at angles of $45° + n90°$ with no filter interposed into the optical light path. In order to form four color half-tone copies from black and white color separations, an additional exposure is required when the square array of dots in disc 60 is at a 30° or 60° angle with respect to the horizontal of housing window 64. In this case, if it is desired to make all exposures at equal time intervals, the screen rotation velocity should be appropriately reduced between 15° and 30° or 45° and 60°, while remaining substantially constant in the other intervals.

Lens 16 is a six element split dagor type of lens having a front and back compound components with aperture system 18 centrally located therebetween. The front lens component **16*b* has three lens elements including, in the following order; a first lens element of positive power, a second lens element of negative power cemented to the first lens element, and a third element of positive power disposed between the second lens element and aperture system 18. The back lens element 16*a* also has three similar lens components positioned so that lens 16** is symmetrical. In a specific embodiment of the lens, the first lens element of the frong component is a double convex lens, the second lens element a concave lens and the third lens element a convex-concave lens element.

Aperture system 18, interposed between lens portions **16*a* and 16*b*, includes a synchronous speed motor 66 rotating an opaque disc 68 in a window 70 of housing member 72. One skilled in the art will appreciate that a stepping motor may be employed instead of a synchronous speed motor to advance disc 68. In fact, the foregoing may be achieved manually under operator control. However, in all of the foregoing, the appropriate aperture in disc 68 is aligned in the optical path in conjunction with the corresponding colored filter. Disc 68 has a plurality of equally spaced apertures disposed at a pre-selected radius and angular orientation therein. Thus, if four apertures are employed they are 90° apart with each aperture being of a different size to vary the contrast of the half-tone light image subsequently produced by screen member 22. Neutral density filters or other means for adjusting light intensity may be associated with each of these differently shaped and sized apertures in disc 68 so as to regulate the intensity of the light transmitted through the respective aperture. Motor 66 rotates disc 68 in synchronism with the rotation of disc 60 having the dots thereon. The size of the aperture and the optical density of the neutral density filter interposed into window 70 of housing 72 depends upon the color of the filter being interjected into the optical light path by filter mechanism 20. In this way, properly balanced single color light images may be employed to irradiate charged photoconductive belt 26. While two motors have been shown to rotate disc 60 of screen member 22 and disc 68 of aperture system 18,** it will be obvious to one skilled in the art that a single motor may be employed with suitable coupling between the respective discs.

Figure 4:
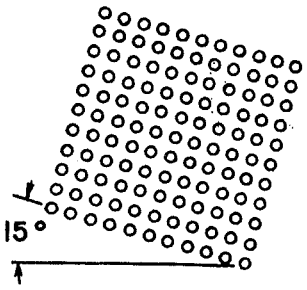
FIG. 4 depicts a preferred orientation for the screen member when a green filter is interposed into the optical system.
Figure 5:
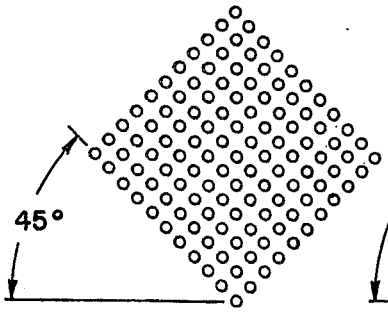
FIG. 5 depicts a preferred orientation for the screen member when a red filter is interposed into the optical light path.
Figure 6:
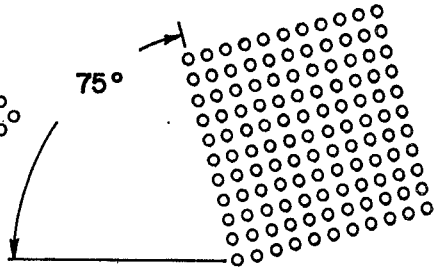
FIG. 6 illustrates a preferred orientation for the screen member when a blue filter is interposed into the optical light path.

With continued reference to FIG. 3, filter 20 comprises a housing 74 having a window 76 therein. Window 76 is positioned relative to lens 16 to allow the light reflected from original document 12 to pass therethrough. The bottom and top walls of housing member include a plurality of tracks which extend the entire width thereof. Each track has a filter therein. These tracks allow movement of the filters from an inoperative position to an operative position interposed in the window of the housing to allow light rays to pass therethrough. The individual filters are made from a suitable material such as coated glass. Three filters are employed in the FIG. 1 electrophotographic printing machine. The filters are biased into position in the window of the housing member by individual exension springs. When inoperative, the filters are retained out of the line of the housing window by means of stop pins which extend up through an opening in the bottom of the housing member into the respective tracks of each filter. Solenoids, in association with each stop pin, retain the filters in the inoperative position. A selected filter is then inserted into the optical path of the housing window by activation of the appropriate solenoid. Activation of the solenoid moves the stop pin corresponding to the selected filter downwardly from the track thereof. This permits the spring cooperating with the filter to pull the filter into the optical light path of the housing window. When a black and white copy is being reproduced no filter is interposed into the housing window and a total light image rather than a partial light image is formed on photoconductive belt 26. Preferably, filter mechanism 20 includes three filters, a blue filter, a red filter and a green filter. Each of the filters is associated with its respective toner particles, i.e. the complement of the color thereof, to produce a subtractive system. As heretofore indicated, a green filtered light image is developed with magenta toner particles, a blue filtered light image being developed with yellow toner particles, and a red filtered light image being developed with cyan toner particles. As heretofore indicated, the square array of dots on disc 64 of screen member 22 rotates through an angle of about 15° on the equivalent thereof when a green filter is interposed into the optical light path. A red filter is interposed into the optical light path when the square array of dots has rotated through an angle of about 45° on the equivalent thereof. Finally, a blue filter is interposed in the optical light path when the square array of dots has rotated through an angle of about 75° or the equivalent thereof. In FIGS. 4 through 6, inclusive, typical standard dot patterns, greatly magnified illustrate the specific angles from the horizontal. Any two successive dot patterns have an angular difference of about 30°.

Turning now to FIGS. 4 through 6, inclusive, in operation, a square array of dots is continually rotating within the housing window. A flash illumination system is periodically excited as the square array of dots reaches pre-selected angular orientations relative to the horizontal in the plane of rotation. Thus, when the square array of dots is rotated through 15° (as shown in FIG. 4) a green filter is interposed into the optical light path. The illumination system is then activated producing a green half-tone light image with the square array of dots being at a 15° angle. As the square array of dots continues to rotate, a red filter is interposed into the optical light path when the square array of dots has reached about a 45° angle (as shown in FIG. 5). At this time, light source 10 is once again energized producing a red half-tone light image. Finally, a blue filter is interposed into the optical light path when the square array of dots is rotated through about a 75° angle (as shown in FIG. 6). At this time, light source 10 is energized producing a blue half-tone light image. These successive single color half-tone light images irradiate the charged photoconductive surface producing successive single color electrostatic latent images which are developed with toner particles complementary in color thereto. The toner powder images are transferred, in superimposed registration with one another, to a sheet of support material, and, subsequently, fused thereto forming a color copy of the original document. In addition to rotating the screen member, the size of the lens aperture and optical density of the associated neutral density filter may be varied so as to properly balance the intensity of illumination irradiating the photoconductive surface and the contrast produced by screen member 22 for differing colored light images.

In recapitulation, it is evident that the optical system utilized in the electrophotographic printing machine herein before described produces half-tone light images of variable contrast. The half-tone pattern is reoriented for each successive single color light image to optimize the images being produced. Moreover, the size of aperture within the lens system is adjusted to transmit the optimum intensity light rays therethrough for each successive single color image being formed.

While the optical system of the present invention has been described as being employed in a colored electrophotographic printing machine utilizing dry or powder toner, it is obvious to one skilled in the art that the invention is not necessarily so limited in its use. By way of example, the optical system may be employed in a black and white electrophotographic printing machine using liquid development. Similarly, the optical system may be employed in a photoelectrophoretic imaging system.

It is, therefore, evident that there has been provided in accordance with the present invention, an optical system that fully satisfies the objects, aims and advantageous set forth above. While this system has been described in conjunction with specific embodiments thereof, it is evident that many alternatives, modifications and variations will be apparent to those skilled in the art. Accordingly, it is intended to embrace all such alternatives, modifications and variations as fall within the spirit and scope of the appended claims.

What is claimed is:

1. An optical system for projecting a light image of an original document onto a light sensitive member, including:

means for illuminating the original document;

means, in a light receiving relationship with the light rays transmitted from the original document, for forming a light image thereof, a screen member interposed in the optical path so that the light image passes therethrough;

means for rotating said screen member at a substantially constant angular velocity;

means for activating said illuminating means at preselected time intervals as said screen member rotates to generate successive half-tone light images at different angles of said screen member;

a substantially opaque member having a plurality of different size apertures therein, said opaque member being operatively associated with said image forming means; and means for rotating said opaque member in synchronism with the rotation of said screen member, said opaque member being rotated to locate a preselected size aperture in the optical light path upon actuating said illuminating means.

2. An optical system as recited in claim 1, further including:

a filter mechanism comprising a plurality of differently colored filters; and means for interposing one of said colored filters in the optical path to produce successive single color half-tone light images at differing angles of said screen member.

3. An optical system as recited in claim 2, wherein said screen member includes a transparent plate having a substantially square array of dots thereon.

4. An optical system as recited in claim 3, wherein said activating means excites said illuminating means at timed intervals corresponding to said array of dots on said screen member rotating about 30°.

5. An optical system as recited in claim 4, wherein the colored filters of said filter mechanism include:

a blue filter;

a green filter; and a red filter.

6. An optical system as recited in claim 5 wherein:

said interposing means moves said green filter into the optical path when said array of dots on said screen member have rotated to discrete angles of 15°, 105°, 195° and 285°;

said interposing means moves said red filter into the optical path when said array of dots on said screen member have rotated to discrete angles of 45°, 135°, 225° and 315°; and said interposing means moves said blue filter into the optical path when said array of dots on said screen member have rotated to discrete angles of 75°, 165°, 255°, and 345°.

7. An apparatus as recited in claim 1, wherein:

said screen member includes a substantially square array of dots; and said activating means excites said illuminating means at timed intervals corresponding to said array of dots having rotated to discrete angles of 45°, 135°, 225° and 315°.

8. An electrophotographic printing machine for reproducing an original document, including:

a photoconductive member;

means for charging said photoconductive member to a substantially uniform level; and an optical system for projecting a light image of the original document onto said charged photoconductive member recording an electrostatic latent image thereon, said optical system comprising means for illuminating the original document, means, in a light receiving relationship with the light rays transmitted from the original document, for forming a light image thereof, a screen member interposed in the optical path so that the light image passes therethrough, means for rotating said screen member at a substantially constant angular velocity, means for activating said illuminating means as the screen member rotates to generate successive half-tone light images at differing angles of the screen member, a substantially opaque member having a plurality of different sized apertures therein, said opaque member being operatively associated with the image forming means, and means for rotating said opaque member in synchronism with the rotation of the screen member, said opaque member being rotated to locate a preselected size aperture in the optical light path upon actuating the illuminating means.

9. A printing machine as recited in claim 8, wherein said optical system further includes:

a filter mechanism comprising a plurality of differently colored filters; and means for interposing one of said colored filters in the optical path to produce successive single color half-tone light images at differing angles of the screen member.

10. A printing machine as recited in claim 9, wherein the screen member of said optical system includes a transparent plate having a substantially square array of dots thereon.

11. A printing machine as recited in claim 10, wherein the activating means of said optical system excites the illuminating means at timed intervals corresponding to the array of dots on the screen member rotating about 30°.

12. A printing machine as recited in claim 11, wherein the color filters of the filter mechanism of said optical system includes:

a blue filter;

a green filter; and a red filter.

13. A printing machine as recited in claim 12, wherein the interposing means moves the green filter into the optical light path when the array of dots on the screen member have rotated to discrete angles of 15°, 105°, 195° and 285°, the interposing means moves the red filter into the optical light path when the array of dots on the screen member have rotated to discrete angles of 45°, 135°, 225° and 315°, and the interposing means moves the blue filter into the optical light path when the array of dots on the screen member have rotated to discrete angles of 75°, 165°, 255° and 345°.

14. A printing machine as recited in claim 8, wherein:

the screen member of said optical system includes a substantially square array of dots; and the activating means of said optical system excites the illuminating means thereof at timed intervals corresponding to said array of dots having rotated to discrete angles of 45°, 135°, 225° and 315°.

* * * * *